United States Patent [19]

Weidner

[11] 4,368,670

[45] Jan. 18, 1983

[54] DETONATOR WITHOUT INITIATING EXPLOSIVE

[75] Inventor: Peter Weidner, Breitenbrunn, Fed. Rep. of Germany

[73] Assignee: Diehl GmbH & Co., Nuremberg, Fed. Rep. of Germany

[21] Appl. No.: 173,335

[22] Filed: Jul. 29, 1980

[30] Foreign Application Priority Data

Aug. 4, 1979 [DE] Fed. Rep. of Germany ..... 2931765

[51] Int. Cl.[3] ..... F42C 19/12

[52] U.S. Cl. ..... 102/202.5

[58] Field of Search ..... 102/210, 202, 202.5, 102/205

[56] References Cited

U.S. PATENT DOCUMENTS 3,438,326 4/1969 Thomanek et al. ..... 102/210

*Primary Examiner*—Charles T. Jordan

*Attorney, Agent, or Firm*—Scully, Scott, Murphy & Presser

[57] ABSTRACT

A detonator for the electrical ignition or detonation of detonating materials, such as explosives. The detonator incorporates at least one piezo element which is at least partially encompassed by a secondary explosive. The piezo element is subjected to a steeply rising voltage impulse and thereby rapidly expanded so as to generate a shock wave which will detonate the secondary explosive.

11 Claims, 4 Drawing Figures

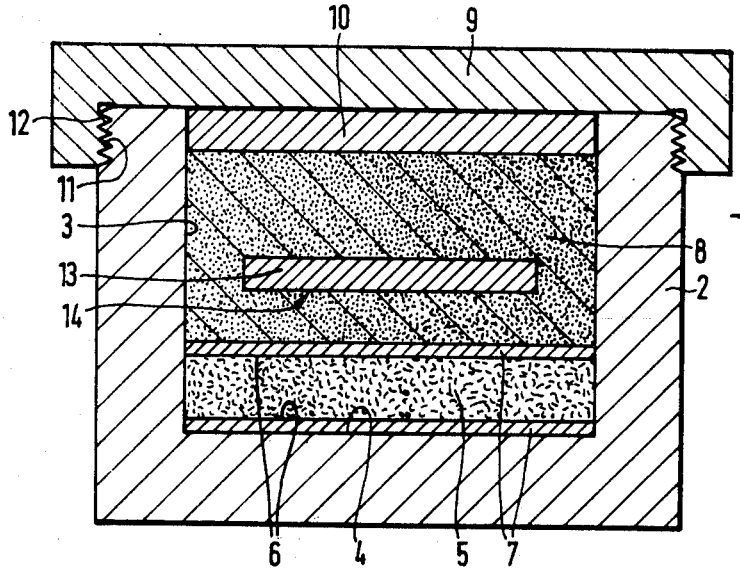
Fig. 1
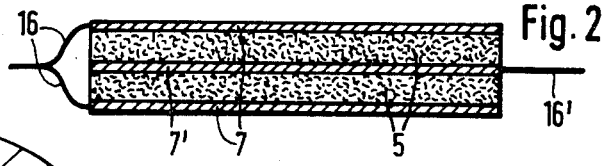
Fig. 2
Fig. 3
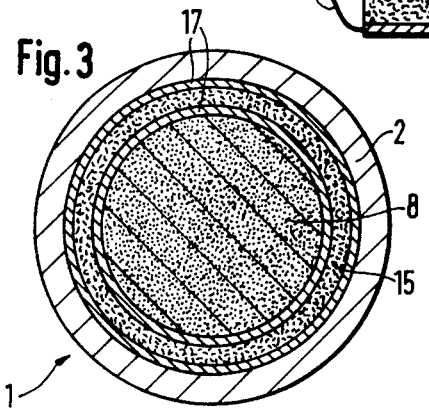
Fig. 4
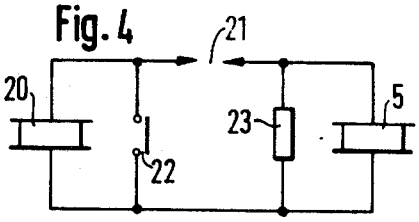

DETONATOR WITHOUT INITIATING EXPLOSIVE

BACKGROUND OF THE INVENTION

1. Field of the Invention

The present invention relates to a detonator for the electrical ignition of detonating materials, in particular explosives.

2. Discussion of the Prior Art

A detonator for the direct electrical ignition or detonation of secondary explosives has already become known from German Pat. No. 16 46 337. This detonator relates to a gap-pole member, the gap of which is bridged by a thin and at least semi-conductive layer. In order to achieve a high ignition quality for the secondary explosive, the grain size distribution of the explosive is so selected that at least the portion of the secondary explosive which lies against the semi-conductive layer possesses specific surfaces in the range of between 300 and 10,000 $cm^2/g$.

The disadvantage of this known arrangement, on the one hand, lies in the quite complicated construction of the gap-pole member which has a gap width for the pole member of between 20 and a few 100$\mu$, which sets demands for finely-precisioned mechanical components for the manufacturing devices and, resultingly, renders the detonator more expensive. On the other hand, the mounting and contacting of the semi-conductive layer represents an additional expensive and complex manufacturing procedure. Furthermore, the dependable functioning of this known prior art detonator requires an accurate knowledge of the grain size distribution of the employed secondary explosive, the desired fine granularity and, in effect, specific surface must be achieved through grinding of the commercially available secondary explosive.

SUMMARY OF THE INVENTION

Accordingly, it is an object of the present invention to produce in a simple manner a detonator without an initiating or triggering explosive of the above-mentioned type, without necessitating the extremely expensive and complex manufacturing steps of the above-mentioned German patent.

In order to achieve the foregoing object of the invention, the detonator inventively incorporates at least one piezo element which is at least partially encompassed by secondary explosive, which can be subjected to a steeply rising voltage impulse and thereby extraordinarily rapidly expanded whereby the adjacent contacting secondary explosive can be resultingly triggered through the generated shock wave.

In this invention there is utilized the property of explosives which can be triggered by a percussion or impact pressure. Thus, for example, tetryl can be triggered by an impact pressure of from about 10 kbar.

In this instance, it is a novel principle that for the generation of a shock wave in the secondary explosive which leads to the triggering of the explosive, that there is utilized the piezo-electric effect. With a disc constituted of a predetermined piezo ceramic and at a compression of about 1 $\mu$m, a voltage of 2 kV can be taken off at the oppositely located surfaces. Conversely, at the application of an oppositely poled voltage of 2 kV there occurs an expansion of about 1 $\mu$m. This expansion propagates extremely rapidly at a correspondingly steep voltage rise so as to trigger a shock wave in the medium encompassing the ceramic, which forms due to the mass moment of inertia of the explosive and which accelerates during the expansion time interval.

In accordance with military standards, all primary explosives (initiating explosives) must be securable, in effect, must be pivotable out of the line of detonation or, respectively, separable through the use of discs from the main charge of the secondary explosive. For secondary explosives this is not prescribed in an obligatory manner. The limit of sensitivity can be found with tetryl. The utilization of tetryl or, respectively, of other secondary explosives of the same or lower sensitivity hereby leads to a significant simplification in the construction of detonators since the otherwise necessary complicated mechanical safety arrangements become superfluous. It is also advantageous that in the present invention there can be employed commercially available secondary explosives without the need for additional grinding.

In a preferred embodiment of the invention there are utilized two or more piezo elements which are connected electrically in parallel and mechanically in series. Herewith, at a predetermined maximum voltage, there can be increased the overall attainable expansion amplitude of the piezo elements.

Further modifications of the invention contemplate that the detonating capsule can be constructed in a packed down or unpacked manner which, pursuant to the type of application, represents a further advantage.

A preferred embodiment of the invention further contemplates that a metal powder and/or other additives are admixed with the secondary explosive so as to increase the density of the secondary explosive. Through this measure the formation of a shock wave is rendered easier. The same goal is served by a heavy-metal insert, preferably one of lead, which is encompassed by secondary explosive and is arranged to extend in parallel opposite the piezo element whereby the cross-sectional surface of the heavy-metal insert is smaller than the cross-sectional surface of a recess formed in the detonator.

It is also advantageous in the present invention that the cross-sectional surface of the piezo element is constructed in conformance with the inner cross-sectional surface of the recess in the detonator so that the shock wave will expand as a planar surface through the secondary explosive.

In a further preferred embodiment of the invention the piezo element is formed as a tubularly-shaped member having electrodes coaxially arranged on the outer circumference and inner circumference thereof, and which is internally and/or externally encompassed by secondary explosive. This exemplary embodiment, above all, can be advantageously employed in rotationally-symmetrical members. For rapidly rotating projectiles the steeply rising voltage impulse is hereby to be selected at such a magnitude so as to compensate for the piezo voltage which is generated by the centrifugal acceleration.

BRIEF DESCRIPTION OF THE DRAWINGS

Reference may now be had to exemplary embodiments of the invention taken in conjunction with the accompanying drawings; in which:

FIG. 1 illustrates a cross-sectional view through a detonator in a packed arrangement and having a heavy-metal insert positioned opposite a piezo element;

FIG. 2 illustrates an embodiment with two piezo elements which are connected electrically in parallel and mechanically in series;

FIG. 3 illustrates a sectional view through a detonator with a tubularly-shaped piezo element, which is reinforced along its external circumference; and FIG. 4 illustrates an electronic circuit for the ignition of the detonator.

DETAILED DESCRIPTION

Referring now in detail to the drawings, FIG. 1 illustrates a detonator 1 consisting of a cup-shaped container 2, preferably constituted of steel, which includes a recess 3 whose transverse surface 4 is larger or equal in size to the contact surfaces 6 of a plate-shaped piezo-element 5 which is arranged on the transverse surface 4 of the recess 3. Arranged on both sides of the plate-shaped piezo element 5 in a usual manner are laminarly constructed and insulated electrodes 7 which, by means of electrode leads (not shown), supply the necessary energy to the piezo element 5 for ignition. Secondary explosive 8 is directly pressed, for example, against one side of the piezo element 5 which is provided with the electrodes 7 and, thereby, the receptacle 2 is filled. For the purpose of tamping, the recess 3 is closed off through the intermediary of a packing or cover disc 9 and an equalizing plate 10 both of which, for example, are constituted of metal. The cover disc 9 is threaded together with the cup-shaped container 2, for example, by means of a screw thread 11 which is correspondingly present also on the upper exterior rim 12 of the circular cup-shaped container 2. The cover disc 9 hereby presses with its planar inside against the similarly planar circularly-shaped adjusting or equalizing plate 10 which is fitted into the recess 3 and, in turn, is positioned on the secondary explosive 8. In order to enhance the explosive effect, there can, inventively, be provided a heavy-element insert 13 as a thrust member, preferably constituted of lead, and arranged opposite piezo element 5 wherein the heavy-metal insert 13 is on all sides thereof encompassed by the secondary explosive 8. In a circular container 2 this heavy-metal insert 13 can be constructed as a circular cylindrical disc whose transverse surface 14 is smaller than the transverse surface 4 of the recess 3, and which is arranged coaxially within the recess 3. Within the context of this invention there can also be employed other containers 2 which are not rotationally-symmetrical and whose recess 3 and heavy-metal inserts 13 do not possess circular cross-sections. Inventively, it is also conceivable that the secondary explosive 8 is positioned directly on the bottom of the container and that the piezo element 5 is arranged between the secondary explosive 8 and the equalizing plate 10.

In a preferred embodiment of the invention as illustrated in FIG. 2, there are utilized two piezo elements 5 which are superimposed on each other and separated through a thin lamilarly constructed center electrode 7' provided with an electrode lead 16', wherein the outer electrodes 7 can be connected with each other through electrode leads 16. Since lengthy electrode leads 16 and 16' are subjected to correspondingly high inductivities, due to necessary steeply rising voltage impulses necessary for ignition, there are preferably used short electrode leads 16 and 16'. The utilization of an unpacked detonator 1 may also be of advantage. In this instance, the cover disc 9 and the equalizing plate 10 can be arranged so as to be removable.

Pursuant to a further inventive exemplary embodiment there can be employed a tubularly-shaped piezo element 15 within the container 2 having now arranged coaxially on the inner and outer circumferences thereof annularly-shaped electrodes 17, as well as secondary explosive 8 interiorly thereof. The electrodes 17 are provided with supply leads in a manner not illustrated in detail herein. At the application of a steeply rising voltage impulse to the two electrodes 17, there is generated a radially inwardly propagating shock wave in the secondary explosive 8.

In modifications of this exemplary embodiment it is also possible to contemplate embodiments in which the secondary explosive 8 is arranged within as well as exteriorly of the piezo element 5. Furthermore, there can also be inventively utilized two or more concentric, oppositely movable tubularly-shaped piezo elements 15 which compress the intermediately arranged explosive.

This modification of the invention can also be applied to the plate-like piezo elements 5 of FIGS. 1 and 2, wherein the secondary explosive 8 is arranged intermediate the oppositely moving piezo elements 5.

The generation of the voltage impulses leading to detonation or ignition can be inventively effectuated through an electronic circuit as shown in FIG. 4 and which is described hereinbelow. A piezo generator 20 generates, in an already known manner, electrical energy which upon reaching a sufficiently high voltage of, for example, 2 kV over a spark discharge gap 21 is charged over to the capacitance of the piezo elements 5 or 15, and thereby detonates the secondary explosive 8. Hereby, the piezo generator 20, the spark discharge gap 21 and the piezo elements 5 or 15 are connected electrically in series. In a preferred embodiment, a safety switch 22 is connected in parallel with the piezo generator 20, the switch being short-circuited, for instance, up to the firing of the projectile. Furthermore, it is advantageous to connect a relatively high-ohmic resistor 23 in parallel with the piezo element 5 or 15 so as to reduce the charges which are produced comparatively slowly at the piezo elements 5 or 15 through, for example, ionization.

What is claimed is:

1. A detonator without initiating explosive for the electrical detonation of explosives; comprising at least one piezo element; a secondary explosive at least partially encompassing said piezo element and being subjectable to a steeply rising voltage impulse so as to rapidly expand and generate a shock wave, said secondary explosive being detonated by said shock wave.

2. A detonator as claimed in claim 1, comprising at least two of said piezo elements, said piezo elements being electrically connected in parallel and mechanically connected in series.

3. A detonator as claimed in claim 1 or 2, said detonator containing said piezo element and said explosive being provided with packing means for the detonator contents.

4. A detonator as claimed in claim 1 or 2, said detonator being unpacked.

5. A detonator as claimed in claim 1, comprising metal powder and other additives being admixed with said secondary explosive so as to increase the density of said secondary explosive.

6. A detonator as claimed in claim 1, comprising a plate-shaped heavy-metal insert encompassed by said secondary explosive being arranged in parallel opposite said piezo element; a recess in said detonator for receiving said insert and said piezo element, the transverse surface of said heavy-metal insert being smaller than the transverse area of said recess containing the secondary explosive.

7. A detonator as claimed in claim 6, said heavy-metal insert being formed of lead.

8. A detonator as claimed in claim 6, said plate-shaped piezo elements having contact surfaces corresponding to the transverse surface of said recess in said detonator.

9. A detonator as claimed in claim 1, said piezo element being a tubular member; annularly-shaped electrodes being coaxially arranged at the outer and inner circumferences of said member; and secondary explosive encompassing said member interiorly and exteriorly.

10. A detonator as claimed in claim 1, comprising a piezo generator for generating the steeply rising voltage impulse; a spark discharger connecting said piezo generator with said piezo element; and a short-circuiting switch being connected in parallel with said piezo generator.

11. A detonator as claimed in claim 1, comprising a resistor connected in parallel with said piezo element.

* * * * *